United States Patent [19]

Herden

[11] Patent Number: 4,549,114

[45] Date of Patent: Oct. 22, 1985

[54] SPARK PLUG FOR EXTERNALLY IGNITED INTERNAL COMBUSTION ENGINE

[76] Inventor: Werner Herden, Hölderlinstrasse 5, D-7016 Gerlingen, Fed. Rep. of Germany

[21] Appl. No.: 575,007

[22] Filed: Jan. 30, 1984

[30] Foreign Application Priority Data

Mar. 10, 1983 [DE] Fed. Rep. of Germany ..... 3308522

[51] Int. Cl.[4] ..... H01J 7/44; H01J 13/46; H01J 19/78; H01J 29/96

[52] U.S. Cl. ..... 315/58; 123/169 MG; 123/144; 313/123; 313/124; 313/142; 315/59

[58] Field of Search ..... 315/56, 58, 59, 60; 313/123, 124, 142; 123/143 A, 143 B, 169 MG, 144

[56] References Cited

U.S. PATENT DOCUMENTS

| | | | |
|---|---|---|---|
| 2,376,362 | 5/1945 | Kasarjian | 315/58 X |
| 3,267,325 | 8/1966 | Why | 315/58 |
| 3,353,052 | 11/1967 | Barry | 313/123 |
| 4,020,388 | 4/1977 | Pratt, Jr. | 315/58 |

FOREIGN PATENT DOCUMENTS

| | | |
|---|---|---|
| 2363804 | 6/1975 | Fed. Rep. of Germany . |
| 2810159 | 9/1979 | Fed. Rep. of Germany . |

*Primary Examiner*—Saxfield Chatmon

[57] ABSTRACT

To increase the spark intensity delivered from a spark plug, an auxiliary spark gap (33) is serially connected with an auxiliary capacitor (37) and the main spark gap (42), the auxiliary capacitor being charged through a charging circuit including a resistor (45) connected in shunt to the auxiliary spark gap (33) and the auxiliary capacitor, and a further or second resistor (46) connected in shunt across the auxiliary capacitor and the ground or chassis electrode (15), and a shunt capacitor (51) is connected between the main spark plug terminal (27) and the ground or chassis or counter electrode (11, 15) so that, upon breakdown of the auxiliary spark gap, the main spark gap will have a voltage thereacross formed by the charge voltage of the main or shunt capacitor (51) and the additional voltage on the auxiliary capacitor (37) which had been charged through the resistors connected across the auxiliary capacitor and to the main spark plug terminal (27) and the ground terminal or electrode (15) respectively.

14 Claims, 2 Drawing Figures

SPARK PLUG FOR EXTERNALLY IGNITED INTERNAL COMBUSTION ENGINE

The present invention relates to spark plugs for internal combustion engines, for example of the automotive type, and more particularly to spark plugs which have an auxiliary, internal spark gap, and are combined with a capacitor to enhance the energy transfer at the main spark by the spark plug.

BACKGROUND

Spark plugs with auxiliary spark gaps, usually located internally of the plug element, have already been proposed; it has also been proposed to associate capacitors with the spark plug circuit in order to store electrical energy and to convert the thus stored energy to a more intense spark than otherwise possible upon breakdown of the main spark gap. Such spark plugs are described, for example, in German Patent Disclosure Document DE-OS No. 23 63 804, Holtin, and German Examined Published Patent Application DE-AS No. 28 10 159, Albrecht et al.

THE INVENTION

It is an object to provide the spark plug which has an auxiliary gap and in which the energy of the main spark gap is higher than heretofore possible.

Briefly, the spark plug has a main spark gap and an auxiliary spark gap, the auxiliary or pre-spark gap being physically positioned within the spark plug. A shunt capacitor has one electrode terminal connected to the spark plug cable terminal and another one electrically connected to the counter electrode of the main spark gap, that is, typically, to ground or chassis of the spark plug, when installed in a motor vehicle, to form a shunt path to the circuit forming the auxiliary spark gap and the main spark gap. In accordance with a feature of the invention, an auxiliary capacitor is provided, serially connected in a circuit path between the auxiliary or pre-spark gap and the main spark gap, a first charging resistor is provided which has a high resistance value, connected in parallel to the pre-spark gap and the auxiliary capacitor, and a second charging capacitor, also having a high resistance value, is connected in parallel to the auxiliary capacitor and the main spark gap. The resistors provide a charging path for the auxiliary capacitor.

The arrangement has the advantage that the energy conversion at the main spark gap, during the breakdown of the spark gap, is enhanced and a higher gap voltage is obtainable, without changing the input voltage to the spark plug. Thus, the spark plug permits better transfer of available spark energy from a given ignition system and a given coil at the spark gap itself.

In accordance with a feature of the invention, the capacitors, the resistors, and the auxiliary spark gap are all located within the spark plug structure itself, and integrated therein. Thus, no external auxiliary circuits are necessary. Some of the capacitors can be formed by metallic layers, for example in at least part-cylindrical form within the spark plug, and the resistors by high-resistance paths therein.

DRAWINGS

FIG. 1 is a longitudinal part-sectional, part side view of a spark plug incorporating an auxiliary spark gap and the main spark gap, in which standard and customary elements are shown only schematically, the illustration being provided for showing of the respective elements and not being to scale; and FIG. 2 is the equivalent circuit diagram of the spark plug of FIG. 1.

DETAILED DESCRIPTION

Figure 1:
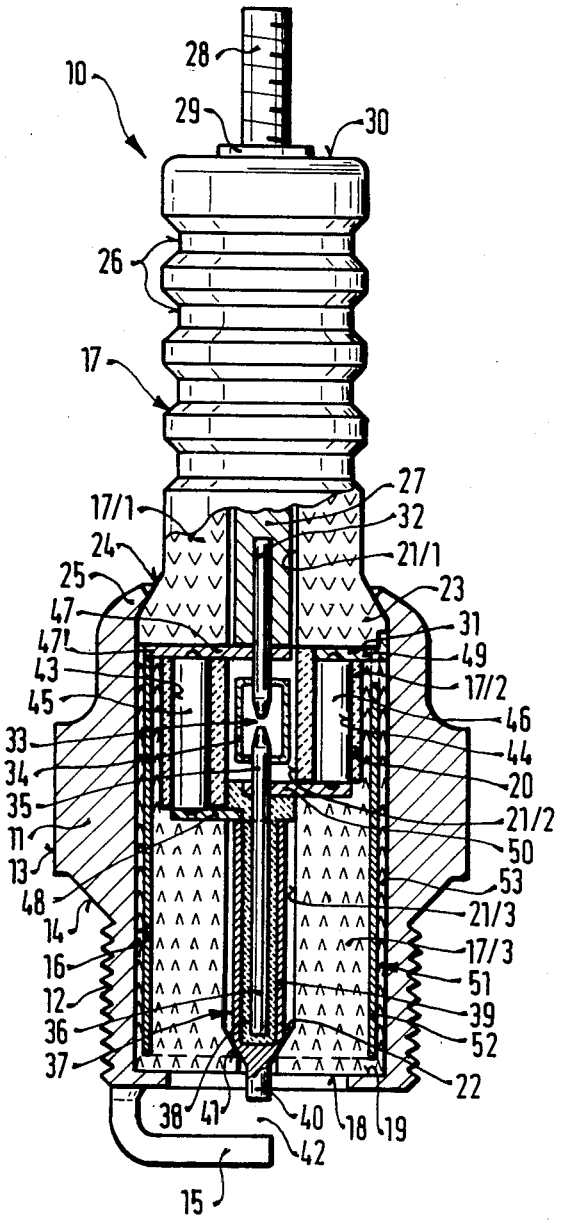

The spark plug 10 is a high-voltage spark plug which has an essentially tubular metal housing 11 which is formed, in standard manner of spark plugs, with an outer engagement thread 12 and a hexagonal engagement surface to receive a spark plug socket to seat the spark plug in a suitably tapped spark plug opening of the engine block of an internal combustion engine, for example an automotive-type internal combustion engine. The metal housing is formed with an inclined surface 14 forming a sealing seat adapted to be engaged, for example, by a suitable compressible sealing ring. The end of the spark plug adapted to fit into the combustion chamber of an internal combustion engine (ICE), that is, the combustion end of the spark plug, has a hook-shaped ground or chassis electrode 15 which projects from the metallic housing 11. The ground or counter electrode 15 may be formed, for example, as a wire element welded to the housing 11. Any other configuration of the counter electrode may be used.

The housing 11 is tubular and formed with a through-opening or through-bore 16, as well known, to receive an electrical insulating body 17, which is rotation-symmetrical, and which extends from the metallic housing 11 at least at the terminal end of the spark plug. The electrical insulating body 17, for example of a ceramic material, made, for example, of aluminum oxide, is formed, essentially, of three portions: A terminal head portion 17/1, a central or insert portion 17/2, and a combustion chamber or ignition end portion 17/3. The end face 18 at the combustion end portion 17/3 of the insulator is engaged by a shoulder 19 formed on the metallic housing and extending inwardly of the internal opening 16 passing through the metallic housing. The end region of the combustion end portion 17/3 of the insulator is formed with a recess 20 in which the central portion 17/2 of the insulator is positioned and secured. The recess 20 in the ignition end portion 17/3 of the insulator is extended to form a longitudinal opening or bore 21/3 which terminates in a shoulder 22 in the vicinity of the end zone close to the ignition side of the ignition end portion 17/3. The longitudinal bore 21/3 is separated from the facing surface 18 of the ignition end portion 17/3 of the insulator. The inner end thereof, that is, the end zone of the longitudinal bore 21/3 facing the connection terminal of the spark plug, is continued within the central portion 17/2 of the insulator in form of a longitudinal bore or opening 21/2. The longitudinal bores or openings 21/3 and 21/2 are further continued in a longitudinal opening 21/1 in the terminal portion 17/1 of the insulator, to extend axially therethrough. The terminal end portion 17/1 is formed with a flange 23 at the side facing the combustion or ignition end, which is retained by a rolled-over edge 25 of the metallic housing 11. The shoulder 23, which is formed as an inclined ring-shaped surface 24, thus, in combination with the metallic housing, securely retains the insulator within the housing 11, and secures the three portions of the insulator 7 together.

In an actual construction, sealing elements and expansion compensation elements to compensate for differential expansion, under heating, of the respective elements of the spark plug 10 will be used, as well known. These elements, since they are standard components in many spark plugs and since their use, installation and operation are well known in connection with spark plug engineering, and have been omitted from the drawing and from the detailed explanation, for simplicity. For example, thermal expansion in sealing elements may be interposed between the shoulder 23 and the rolled-over edge 25 of the metallic housing, or between the inturned shoulder at the combustion end and the end face 18 of the insulator portion 17/3.

The connection end portion 17/1 of the insulator is formed at its outer surface, as well known, with a plurality of grooves 26 in order to extend any possible stray creep current path and to prevent spurious leakage current paths between a terminal post 28 of the spark plug and the metal housing 11, or any other surrounding metallic structure.

The electrical connection to the spark plug is effected by a terminal or connection bolt 27, which extends through the longitudinal 21/1 of the terminal end portion 17/1 of the insulator. The projecting end of the connection bolt is formed with a thread 28. A flange 29 engages the end surface 30 of the insulator portion 17/1.

The ignition end zone of the connection bolt 27 terminates inwardly approximately flush with the inner end zone of the insulator portion 17/1. An electrode 32 of an auxiliary or pre-spark gap 33 is fitted into the bolt 27, and projects therefrom. The pre-spark gap 33 may be constructed in any known manner; preferably, it is located within a spark housing or spark vessel 34, located in the longitudinal bore 21/2 of the insulator element 17/2. A second electrode 35 forms, together with electrode 32, the spark gap 33. The second electrode 35 extends towards the ignition end portion of the spark plug and projects from the pre-spark or auxiliary spark housing or vessel 34.

The second electrode 35 of the auxiliary spark gap 33 extends through a portion of the longitudinal bore 21/3 of the insulator portion 17/3 and forms a first electrode or charge carrier 36 of a capacitor 37, particularly at the end portion close to the ignition end of the spark plug. The second charge carrier or electrode of the thus formed capacitor 37 is formed by a metallic tube 39, separated from the spark gap electrode 35 by a dielectric 38, for example a layer of aluminum oxide applied to the portion of the spark gap electrode 35 which forms the capacitor electrode 36. The tube is closed in the region facing the combustion chamber and is extended in a stub to form the center electrode 40, projecting from the longitudinal bore 21/3 of the insulator portion 17/3. The center electrode is formed with a lateral shoulder or engagement surface 41 with which it can engage or seal against the shoulder 22 in the longitudinal bore 21/3 of the insulator portion 17/3. The stub 40 is spaced from the counter electrode 15 to form the main spark gap 42.

The central or median insulator portion 17/2 is formed with two additional longitudinal bores 43, 44 besides the longitudinal central bore 21/2. A high-resistance resistor 45, 46 is located in the respective bores 43, 44. The high-resistance resistor 45 is connected with the connection bolt 27 by an electrical conductive path or connector 47, located, for example, between the surface 31 of the insulator portion 17/2, which faces the combustion chamber, and the insulator portion 17/2. The resistor 45 is connected with the second electrode 39 of the capacitor 37 by a second connector or conductive path 48 which extends along the end portion facing the ignition side of the spark plug of the central or median insulator portion 17/2.

The high-resistance resistor 46 is connected to the metallic housing 11 by a connected or conductive path 49, extending between the end face 31 of the insulator portion 17/1 and the central or median insulator portion 17/2. The resistor 46 is connected to the second electrode 35 of the auxiliary spark gap 33 by an electrical connector or conductive path 50 which extends along the insulator portion 17/2 at the combustion chamber side thereof. Preferably, connectors 48, 49 are conductive elements embedded in an electrically insulating material which is secured to and connected with the dielectric 38 of the capacitor 37.

In accordance with a feature of the invention, an auxiliary capacitor 51 is provided, formed by a metallic tube 52 which defines one electrode thereof, secured to an external surface of the insulator portion 17/3 of the insulator of the spark plugs, and separated by a thin dielectric layer 53, of any known dielectric material, for example aluminum oxide, from the metallic housing. The metallic housing 11 then forms the second electrode of the capacitor 51. The first electrode of capacitor 51 is connected by a portion 47' of the connection path or connector 47 to the terminal bolt 27 forming the input terminal for the spark plug.

Figure 2:
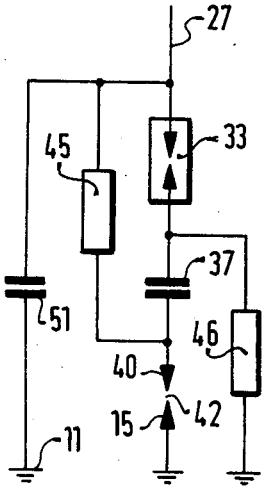

Electrical circuit, and operation, with specific reference to FIG. 2:

The respective elements in FIG. 2 have been given the same reference numerals as those in FIG. 1, for ease of association of the equivalent electrical circuit with the structural arrangement of FIG. 1.

Terminal bolt 27 is adapted for connection to the secondary winding of any standard ignition coil, used with the ICE for externally controlled ignition thereof. A first branch circuit extends from the connecting bolt 27 as follows: auxiliary or pre-spark gap 33—first electrode of capacitor 37—second electrode of capacitor 37—center electrode 40 of the spark gap—spark gap 42—counter or ground or chassis electrode 15—chassis or ground or return connection formed by metallic housing 11.

First shunt path: High-resistance resistor 45 is connected in shunt across a first part-series circuit formed by the auxiliary spark gap 33 and the capacitor 37.

Second shunt path:

The high-resistance resistor 46 is connected in shunt across a second part-series circuit formed by capacitor 37 and the main spark gap 42; and then to the housing 11.

Third shunt path:

The capacitor 51 is connected in shunt across the main current path from connection bolt 27 to the ground or chassis metallic housing 11.

OPERATION

Let it be assumed that an ignition voltage is applied to terminal bolt 27. Capacitor 51 will be charged. The capacitor 51 charges immediately upon application of voltage. Capacitor 37 will be charged over the high-resistance resistors 45 and 46 which, together with the capacitor 47, form a series circuit: resistor 45—capacitor 37—resistor 46 between connection bolt 27 and ground or chassis terminal, formed by the metallic housing. Upon application of voltage, thus, capacitor 51 is charged immediately and capacitor 37 is charged gradually. When the voltage at capacitor 51 has risen to such an extent that the auxiliary spark gap 33 breaks down, the sum of the voltages on the capacitors 51 and 37 is applied across the main spark gap 42, which will receive an intense energy jolt and insure reliable ignition and sparking of the spark gap 42.

The integrated construction illustrated in FIG. 1 is particularly simple and desirable. Of course, some of the elements of the circuit, such as the auxiliary spark gap 33, resistors 45, 46 and the capacitors 37, 51, can be located externally of the spark plug, for example can be integrated in a connection terminal element, connected, then, to a single through-electrode extending from a bolt connector down to the main spark gap 42, as well known in connection with standard spark plugs having a single unitary through-bolt. Alternatively, one or more of the auxiliary elements described may be separately connected. Preferably, the auxiliary elements should be located close to the spark plug 10. The integrated structure described in connection with FIG. 1, and particularly locating the auxiliary spark plug 33 and, preferably, at least one of the capacitors 37 or 51 in coaxial form with respect to the center electrode, is a suitable and preferred solution. The assembly of the spark plug is somewhat more complex, but an overall compact integrated reliable structure results therefrom.

Various changes and modifications may be made, and any features described herein may be used with any others, within the scope of the inventive concept.

In an operative example of a spark plug designed, for use with an automotive-type internal combustion engine, the following values were suitable:

pre-gap 33: 0.5 mm, in nitrogen (5 bar), resistors R45 and R46: they have exactly to be adapted to the parameters of the specific ignition system and preferably have between capacitor C37: 200 . . . 1000 pF, 5 and 50 kΩ. capacitor C51: 200 . . . 1000 pF.

A suitable breakdown voltage for the pre-gap 33 is approximately: 12 kV.

The above spark plug is suitable for use with an ignition coil providing a spark voltage of: 14 kV.

The length of the spark plug from bead 25 securing the terminal portion 17/1 of the insulator in position to the end face 18 of the insulator portion 17/3 is, for example, about: 5 cm.

Spark gap 42: 0.8 mm.

The above values are given as one illustrative example, and may be suitably varied and modified in accordance with standard spark plug engineering practice.

I claim:

1. Spark plug defining a connection end and a sparking end having a spark cable terminal (27, 28) to receive spark energy, at the connection end;

a tubular metal housing (11) having a counter electrode (15) at the sparking end;

a tubular insulator (17) within the tubular metal housing;

a center electrode (40) sealingly received in the tubular insulator (17) and having a terminal end portion positioned close to, but spaced from, the counter electrode (15) to define a main spark gap (42) therewith;

an electrical connection path including an auxiliary or pre-spark gap (33) coupling the cable terminal (27, 28) to the center electrode (40), said spark gap cable terminal (27, 28), the pre-spark gap (33), the center electrode (40), the main spark gap (42) and the counter electrode (15) defining a first circuit branch;

and a shunt capacitor (51) having one electrode terminal connected to the spark cable terminal (27, 28), and another electrode terminal connected to the counter electrode (15) to form a shunt path to said first circuit path, comprising, in accordance with the invention, an auxiliary capacitor (37) serially connected in the first circuit path between the pre-spark gap (33) and the main spark gap (42);

a first charging resistor (45) having high-resistance value connected in parallel to the pre-spark gap (33) and the auxiliary capacitor (37);

and a second charging resistor (46) having high-resistance value being connected in parallel to the auxiliary capacitor (37) and the main spark gap, to form a charging circuit path from the terminal of the auxiliary spark gap remote from the auxiliary capacitor, through the resistor (45) to that one of the electrodes of the auxiliary capacitor (37) which is remote from the auxiliary spark gap (33) and from that one of the electrodes of the auxiliary capacitor (37) which is close to the auxiliary spark gap through the second resistor (46) to the counter electrode (15).

2. Spark plug according to claim 1, wherein the insulator is formed with an internal cavity;

and the auxiliary or pre-spark gap (33) is located within said cavity to form a compact structural unit with the spark plug.

3. Spark plug according to claim 1, wherein at least one of the capacitors (37, 51) comprises a tubular element positoned within the spark plug.

4. Spark plug according to claim 3, wherein the tubular element is coaxial with respect to the center electrode (40).

5. Spark plug according to claim 3, including an elongated metallic element extending essentially centrally of the spark plug and connected to that one of the electrodes of the spark gap remote from the spark cable terminal (27, 28);

and wherein the auxliary capacitor includes a tubular extension (39) surrounding said elongated metallic element (36), with clearance, and a dielectric (38) between the elongated metallic element and the tubular extension.

6. Spark plug according to claim 5, wherein the tubular extension terminates in an end stub (40), said end stub forming said center electrode.

7. Spark plug according to claim 2, wherein at least one of the capacitors (37, 51) comprises a tubular element positioned within the spark plug.

8. Spark plug according to claim 7, wherein the tubular element is coaxial with respect to the center electrode (40).

9. Spark plug according to claim 8, including an elongated metallic element extending essentially centrally of the spark plug and connected to that one of the electrodes of the spark gap remote from the spark cable terminal (27, 28);

and wherein the auxiliary capacitor includes a tubular extension (39) surrounding said elongated metallic element (36), with clearance, and a dielectric (38) between the elongated metallic element and the tubular extension.

10. Spark plug according to claim 7, wherein the tubular extension terminates in an end stub (40), said end stub forming said center electrode.

11. Spark plug according to claim 1, wherein the insulator (17) is formed with internal spaces or cavities;

and wherein the resistors (45, 46), the auxiliary or pre-spark gap (33), and at least said auxiliary capacitor (37) are located within said cavities in the insulator.

12. Spark plug according to claim 11, wherein said shunt capacitor (51) is located within the metal housing of the spark plug, whereby the spark plug will form a compact single integrated spark plug-and-auxiliary circuit unit.

13. Spark plug according to claim 12, wherein the metal housing (11) forms one of the electrodes of the shunt capacitor;

and wherein the other electrode of the shunt capacitor is formed by a metallic sleeve insulated from, and positioned close to, an inner wall of the metal housing.

14. Spark plug according to claim 1, wherein the insulator (17) comprises a plurality of insulator portions (17/1, 17/2, 17/3), fitting together in stacked relation within the metal housing, each one of said portions having end faces extending essentially transversely to the longitudinal extent of the spark plug;

and wherein electrical conductors (47, 47', 48, 50) are located at selected regions of the end faces of at least some of said insulator portions, and interconnecting, internally of the spark plug, at least said auxiliary capacitor, and said first and second charging resistors.

* * * * *

UNITED STATES PATENT AND TRADEMARK OFFICE

CERTIFICATE OF CORRECTION

PATENT NO. : 4,549,114

DATED : OCTOBER 22, 1985

INVENTOR(S) : Werner HERDEN

It is certified that error appears in the above-identified patent and that said Letters Patent is hereby corrected as shown below:

Page 1, left column, please add:

[73] Assignee: Robert Bosch GmbH
Stuttgart, FED.REP.GERMANY

Right column, beneath "Primary Examiner-Saxfield Chatmon"

Please add: Attorney, Agent or Firm -
FRISHAUF, HOLTZ, GOODMAN & WOODWARD, P.C.

Signed and Sealed this

*Ninth* Day of *September 1986*

[SEAL]

*Attest:*

DONALD J. QUIGG

*Attesting Officer*

*Commissioner of Patents and Trademarks*